United States Patent [19]

Hoehn et al.

[11] 4,090,693

[45] May 23, 1978

[54] WINCH VALVE DRAG BRAKE CONTROL

[75] Inventors: Richard F. Hoehn, Pekin; Norman R. Allen, Washington; Ronald E. Wineburner, Pekin, all of Ill.

[73] Assignee: Caterpillar Tractor Co., Peoria, Ill.

[21] Appl. No.: 751,564

[22] Filed: Dec. 17, 1976

[51] Int. Cl.[2] ..... B66D 1/00

[52] U.S. Cl. ..... 254/187.5; 254/150 FH; 192/12 B

[58] Field of Search ..... 254/187.1, 187.4, 187.5, 254/187.8, 150 R, 150 FH; 192/12 C, 18 A; 188/291, 71.2

[56] References Cited

U.S. PATENT DOCUMENTS

| | | | |
|---|---|---|---|
| 2,567,526 | 9/1951 | Nitkey | 254/187 |
| 2,968,369 | 1/1961 | Parrett | 188/71.2 |
| 3,669,229 | 6/1972 | Ronayne | 192/12 C |
| 3,685,621 | 8/1972 | Gulick | 192/12 B |
| 3,841,608 | 10/1974 | Schmitt et al. | 254/187.5 |
| 4,004,779 | 1/1977 | Flesburg | 192/18 A |

*Primary Examiner*—Drayton E. Hoffman
*Assistant Examiner*—Donald W. Underwood
*Attorney, Agent, or Firm*—Phillips, Moore, Weissenberger, Lempio & Majestic

[57] ABSTRACT

The invention is concerned with an improvement in a winch and fluid control system. The preferred system which is improved comprises (1) a rotatable drum for receiving and releasing a cable, (2) a drive train for supporting said drum and for selectively transmitting rotary drive thereto, said drive train including a brake, (3) a source of pressurized fluid, (4) a control valve having an inlet communicating with the source of pressurized fluid and having an outlet system and a valving element which is shiftable between at least three positions including a Brake-On position, a Reel-In position and a Brake-Off position, and (5) a winch lubricating system which communicate said source of pressurized fluid with said winch. Preferably the valving element is also shiftable to a Free-Spool position. The improvement of the present invention comprises a one-way clutch associated with said brake which allows said drum to rotate in a reel-in direction when said brake is engaged; an auxiliary drag brake for stopping reel-in rotation of said drum caused by viscous drag of hydraulic fluid on said drive means when said valving element is in said Brake-On position; and a fluid flow directing system intermediate said winch lubricating system and said auxiliary drag brake which directs a flow of pressurized fluid from said winch lubricating system to said auxiliary drag brake responsive to shifting of said valving element to said Brake-On position and blocks said flow of pressurized fluid from said winch lubricating system to said auxiliary drag brake responsive to shifting of said valving element to any of said Brake-Off and Reel-In positions and, when applicable, said Free-Spool position.

7 Claims, 6 Drawing Figures

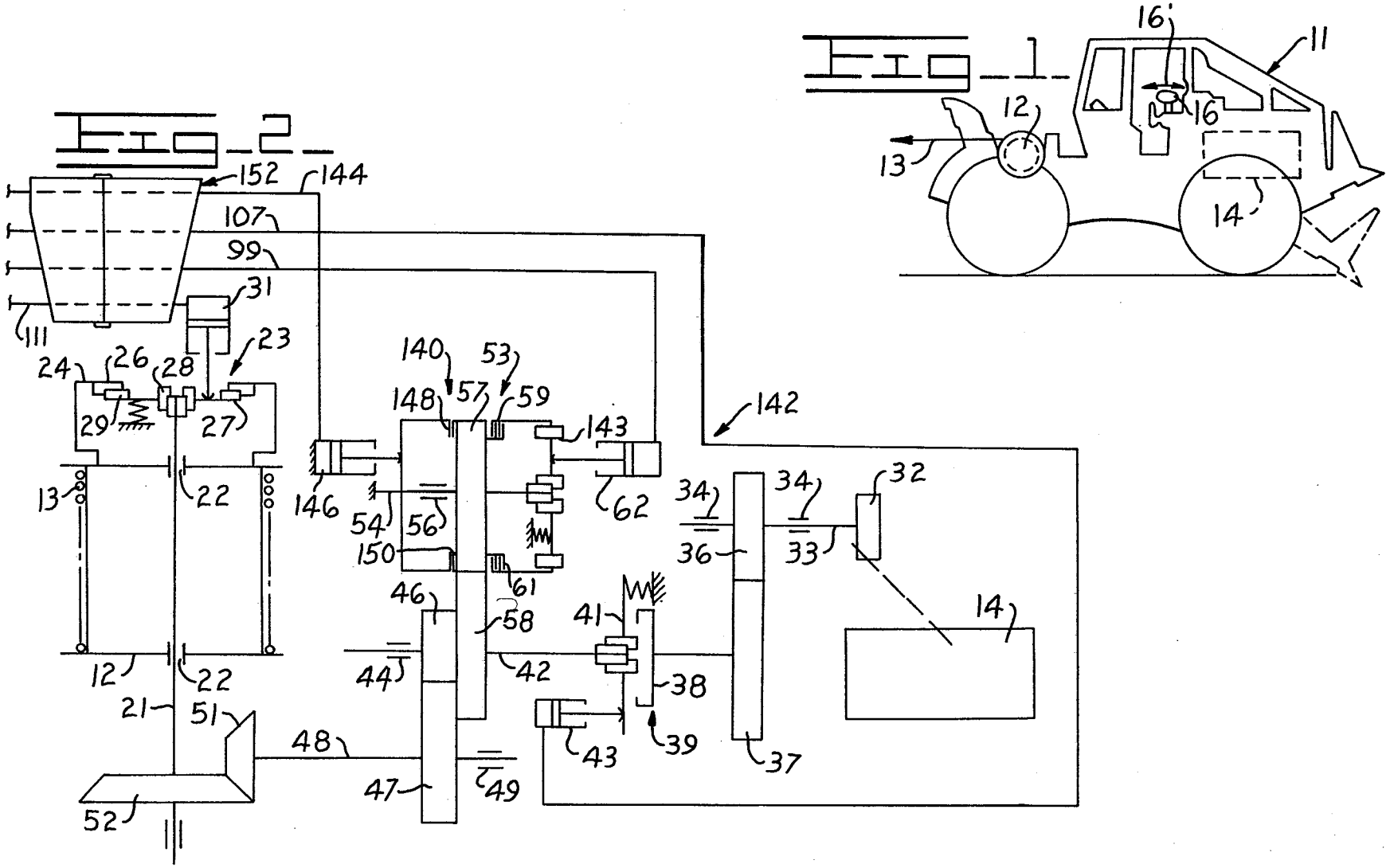
11
14
16
16'
12
13
14
32
33
34
34
36
37
142
38
39
41
43
42
62
143
59
53
57
61
58
49
140
148
56
46
44
47
54
150
146
48
144
152
107
99
31
23
27
22
22
51
28
26
29
24
21
12
13
52
111

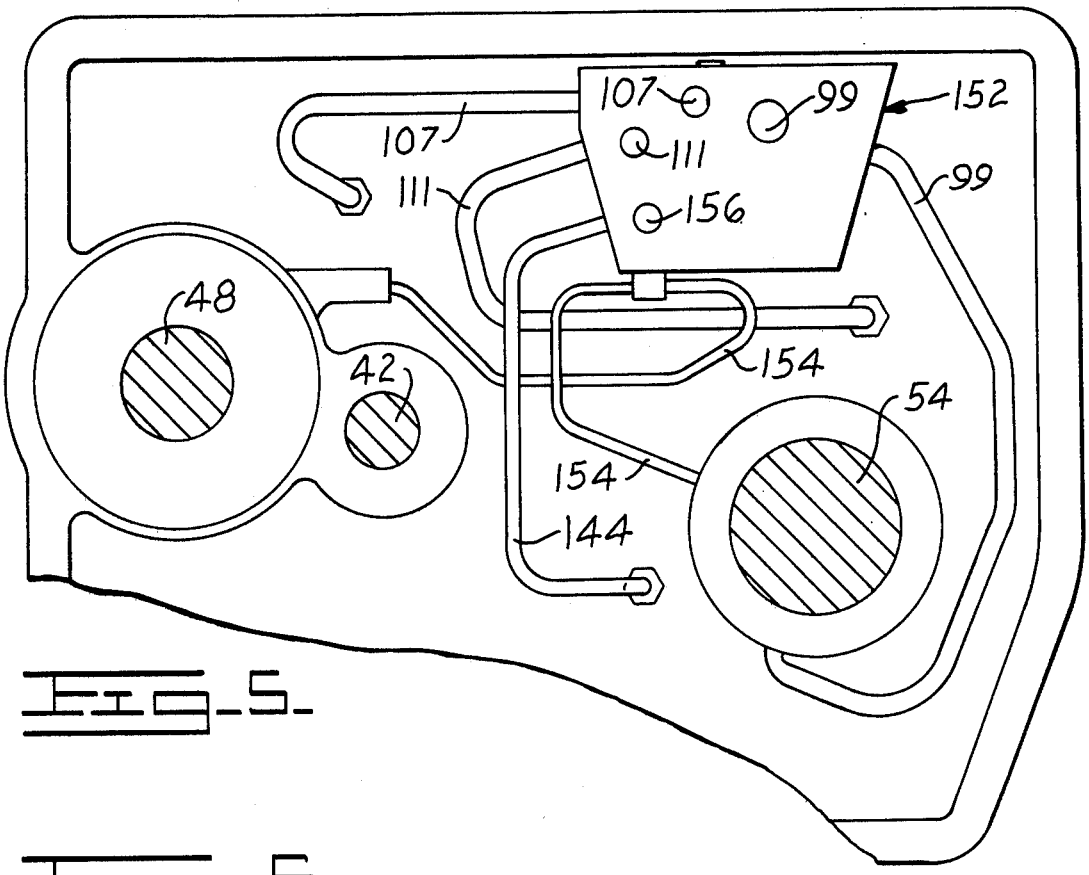
Fig. 5.
Fig. 6.
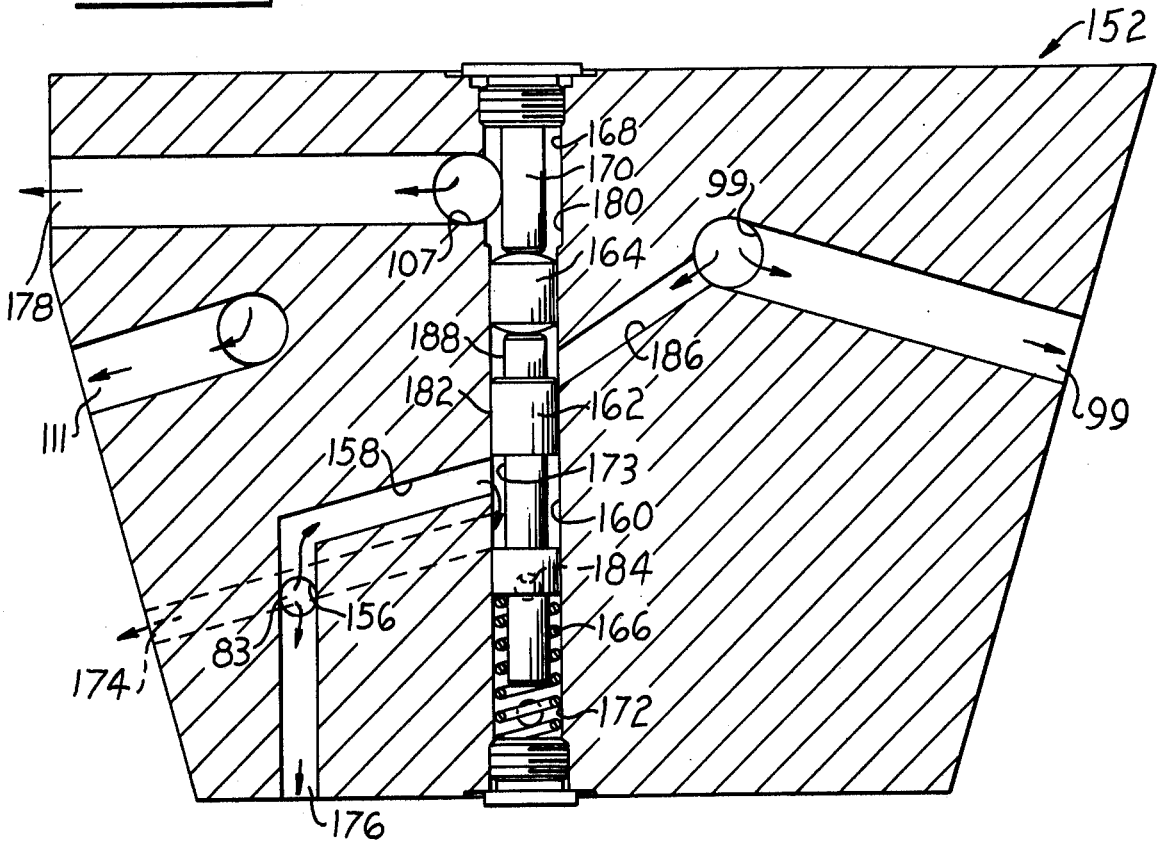

WINCH VALVE DRAG BRAKE CONTROL

BACKGROUND OF THE INVENTION

1. Field of the Invention

This invention relates to winches having a powered rotatable drum for winding in and releasing a cable or the like and more particularly to a winch system of the type in which the drum is driven and controlled by means of fluid pressure-operated clutches and brakes.

2. Prior Art

Prior application Ser. No. 334,354 of L. F. Yates et al., filed Feb. 21, 1973 for "WINCH WITH FREE-WHEELING DRUM" now abandoned and co-pending application Ser. No. 662,320 of L. F. Yates et al., filed Mar. 1, 1976 for "WINCH WITH FREE-WHEELING DRUM" as a continuation-in-part of application Ser. No. 334,354, both assigned to the assignee of the preent application, disclose a winch assembly which is driven by an engine through a drive train having a normally disengaged input clutch which engages in response to fluid pressure to enter a Reel-In mode where it reels in cable. The driven train also includes a normally engaged brake for immobilizing the winch drum and providing a Brake-On mode but which releases in response to fluid pressure in other modes of operation. In addition to the Brake-On and Reel-In modes of operation, the brake alone may be pressurized to effect a Brake-Off mode in which load forces pulling on the line may unwind cable against the limited resistance created by the drag of the drive train components. This limited resistance prevents excess unwinding of cable caused by a load, by drum momentum, or motivated by other causes, but is sufficiently strong that it is difficult or impossible to withdraw cable manually while such resistance is present. Accordingly, the drive train connects to the winch itself through a disconnect clutch which is normally engaged but which may be disengaged by fluid pressure to allow manual unreeling of cable from the drum without working against a substantial resistance thus providing a Free-Spool (or Disconnect) mode. This form of winch assembly is highly useful on a log skidder vehicle, for example, which is used to drag logs from the site of a lumbering operation and also has substantial advantages in other contexts.

Prior U.S. Pat. No. 3,841,608 discloses a hydraulic control system for a winch assembly of this kind in which a manually operated control valve may be shifted between a series of positions to pressurize and depressurize appropriate ones of the clutches and brake of the drive train in order to accomplish the several operational modes described above. The valve settings include Reel-In, Brake-On, Brake-Off and Free-Spool and are realized by movement of a control lever or the like. For safety reasons as well as for convenience of operation, centering springs urge the control valve towards the Brake-On position so that if the operator releases his control lever or the like, the winch is automatically immobilized.

The operator of these winch systems must pay careful attention to the position of his control lever or the like in order to control movement of a load in a safe and efficient manner. It is particularly important to avoid movement of the lever into the Disconnect position through misjudgment while a load is pulling on the cable to be released, creating unwanted slack, when dropping of the load stops or slows. Diversion of the operator's visual attention in order to guard against this occurrence is undesirable in many cses, particularly in such usages as on a log skidder where the operator must pay attention to controlling the vehicle itself in addition to operating the winch.

U.S. Patent application Ser. No. 574,807 of Edward E. Flesburg, filed May 5, 1975 for "WINCH AND FLUID CONTROL SYSTEM THEREFOR", commonly assigned herewith, now U.S. Pat. No. 4,004,779 issued Jan. 25, 1977, discloses means which enable the operator of such winch systems to determine when the control lever is approaching the Free-Spool position without necessarily relying on visual observation.

SUMMARY OF THE INVENTION

It has been discovered by us that in a winch system including at least some of the features as discussed above, and which includes a one way clutch between the normally engaged brake and a stationary support therefor which disengages the brake from the support when the winch is in the Reel-In mode thus allowing the plates of the brake to rotate freely in the Reel-In mode, a particular problem arises when the system is shifted from the Reel-In mode into the Brake-On mode, namely the viscous drag of hydraulic fluid, specifically of lubricating oil, on rotating members of the drive train causes the winch drum to continue to rotate in a Reel-In direction even in said Brake-On mode due to the designed slippage in said one way clutch. This is of course a serious problem since when an operator shifts a winch system into a Brake-On mode it is highly desirable that he be able to then directly and immediately brake the winch drum. We have thus concluded that it would be highly desirable to provide a winch system which had the advantage of being operable in a Reel-In mode even when the brake was engaged but would assure that the winch would not rotate in a reel-in direction in the Brake-On mode.

The present invention provides auxiliary brake means for stopping rotation of a winch drum caused by viscous drag of the hydraulic lubricating fluid on drive members of a winch system along with fluid flow directing means which serves to control actuation and de-actuation of the auxiliary brake means in proper correlated sequence with the shifting of the winch system into any of a Brake-On, Reel-In, Brake-Off and, in a preferred embodiment Free-Spool, mode of operation.

More particularly, the invention is concerned with an important in a winch and fluid control system which comprises (1) a rotatable drum for receiving and releasing a cable, (2) drive means for supporting said drum and for selectively transmitting rotatry drive thereto, said drive means including a brake, (3) a source of presurized fluid, (4) control valve means having inlet means communicating with said source of pressurized fluid and having outlet means, said control valve means having valving element means shiftable between at least three positions including a Brake-On position, a Reel-In position, and a Brake-Off position and (5) winch lubricating means communicating said source of pressurized fluid with said winch. Preferably the valve means is also shiftable to a Free-Spool position. The improvement of the present invention comprises a one-way clutch associated with said brake allowing said drum to rotate in a reel-in direction when said brake is engaged; auxiliary drag brake means for stopping reel-in rotation of said drum caused by viscous drag of hydraulic fluid on said drive means when said valving element means is in said Brake-On position; and fluid flow directing means intermediate said winch lubricating means and said auxiliary drag brake means which directs a flow of pressurized fluid from said winch lubricating means to engage said auxiliary drag brake means responsive to shifting of said valving element means to said Brake-ON position and directs said flow of pressurized fluid from said winch lubricating means to said auxiliary drag brake means to disengage said auxiliary drag brake means responsive to shifting of said valving means to any of said Brake-Off, Reel-In and, when provided, Free-Spool positions.

BRIEF DESCRIPTION OF THE DRAWINGS

The invention will be better understood by reference to the figures of the drawings wherein like numbers denote like parts throughout and wherein:

FIG. 1 illustrates in a side elevation view a log skidder vehicle equipped with a winch system including an auxiliary brake in accordance with the present invention;

FIG. 2 illustrates in a schematic diagram the winch system of FIG. 1 showing the interconnection of drive train and control mechanism elements between the winch drum and the driving engine;

FIG. 3 may be juxtaposed end-to-end with FIG. 2 to form a single figure in which fluid conduit interconnections between the control valve and winch system are readily apparent;

FIG. 5 illustrates in an end view the structural configuration of fluid flow directing means in accordance with the present invention; and FIG. 6 illustrates details in structure of the preferred fluid flow directing means in accordance with the present invention.

DETAILED DESCRIPTION OF THE PREFERRED EMBODIMENT

Figure 3:
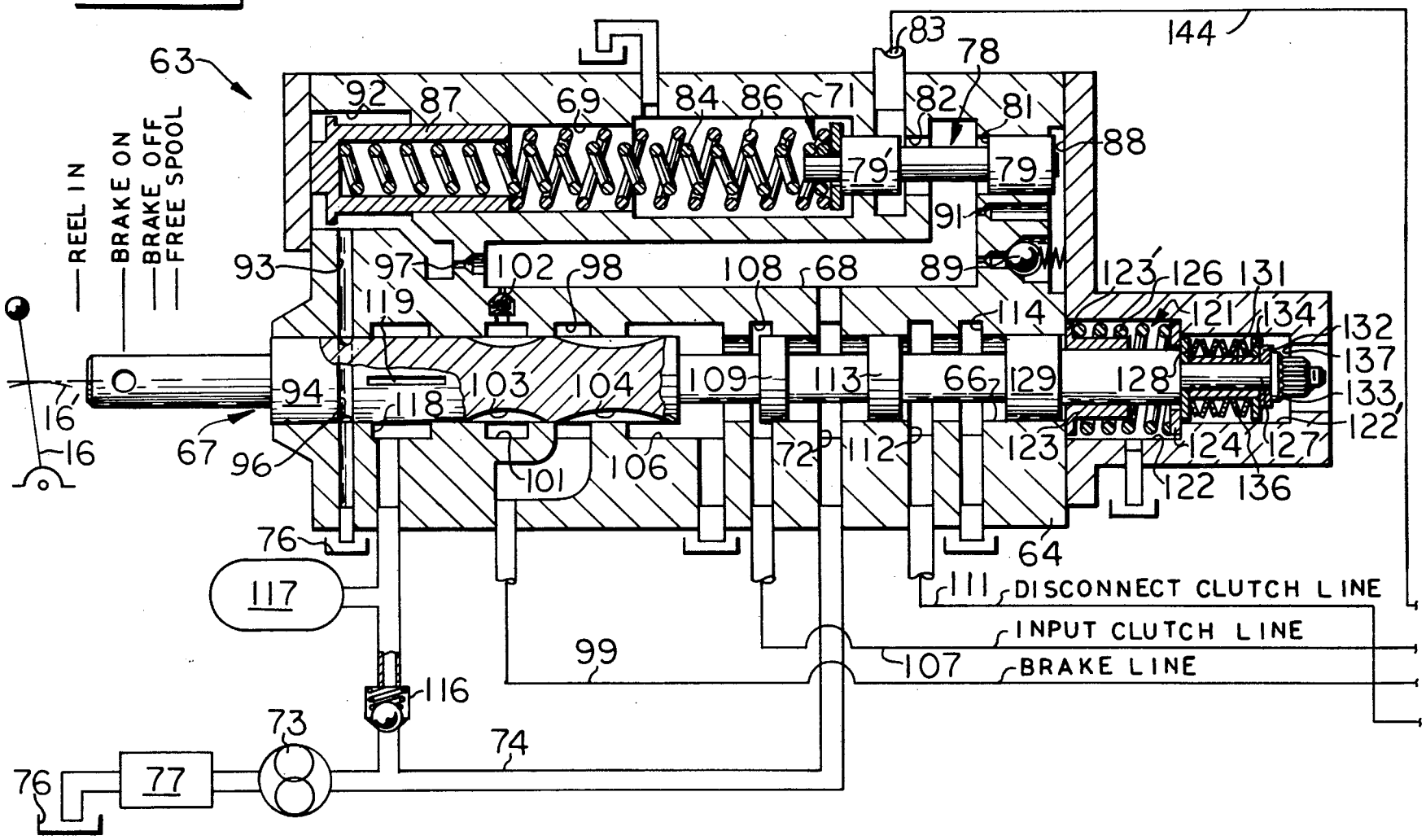
FIG. 3 illustrates in a sectional view a control valve for supplying appropriate fluid pressure to control mechanisms of FIG. 2 in response to movement of an operator's control lever and shows the valve in the Brake-On position at which the winch drum is immobilized.

The winch system of the present invention was initially developed for use on a log skidder vehicle and will therefore be described in that particular context for purposes of example, it being apparent that the apparatus may also be employed on diverse other forms of load-manipulating equipment. Referring initially to FIG. 1, a log skidder vehicle 11 is normally used in lumbering operations primarily for dragging heavy logs away from the site of tree-felling operations. For this purpose, the vehicle is provided with a rotatable winch drum 12 having a length of cable 13 wound thereon.

As is understood by those skilled in the art, it is necessary at times to immobilize the winch drum 12 so that the vehicle may be used to drag a log while at other times cable 13 must be reeled in by driving the drum from a suitable engine such as the vehicle engine 14. At other times it is necessary to release cable from the winch drum 12. If the cable is to be withdrawn from the drum by the weight of the load pulling on the cable, it is desirable that there be some limited resistance to drum rotation. Such resistance prevents overly fast or erratic release of cable and prevents momentum from causing an excess amount of cable to be released when load movement slows or stops. However, there is another cable release mode of operation in which any sizable resistance to rotation of the winch drum 12 is undesirable. This occurs when there is no load fastened to the cable 13 and it is necessary to manually withdraw cable from the drum 12. Under those circumstances, it is desirable that the operator not have to pull against any significant resistance.

The above-identified prior applications Ser. Nos. 334,354 and 662,320 and prior U.S. Pat. No. 3,841,608 disclose a winch mechanism construction and a hydraulic control system therefor and the present system may be essentially similar and may if desired include the control valve modifications of the above-identified copending application Ser. No. 574,807. In this form of winch system, an operator may manipulate a single control lever 16 to establish any of the above-described modes of winch operation. The control lever 16 is pivotable along an arc 16' and has a centered position which is the Brake-On position at which the winch drum is immobilized. The lever 16 may be pivoted to a Reel-In position and may be pivoted to a Brake-Off position at which cable may be withdrawn by load forces pulling on the cable although substantial resistance to such withdrawal must be overcome for reasons to be hereinafter described. In order to free the winch drum from any significant resistance so that cable may readily be withdrawn manually, the control lever may be shifted through the Brake-Off position to an extreme forward setting which is the Free-Spool position. As will hereinafter be described this provides means which substantially increases the resistance to forward lever movement just prior to entering the Free-Spool position to assure that the operator is aware that the lever is about to go to that position.

Referring now to FIG. 2, the winch drum 12 may be supported on a rotatable drive shaft 21 by bearings 22. Except in the Free-Spool mode of operation, the drum 12 is caused to rotate with the drive shaft by a normally engaged jaw clutch 23. Clutch 23 may be of the known form in which an annular member 24 carrying teeth 26 is coupled to the drum while another member 27 is coupled to drive shaft 21 through splines 28 which enable axial movement relative to the drive shaft. Member 27 carries teeth 29 and is spring-biased to a position at which the teeth 29 engage teeth 26. The jaw clutch 23 may be selectively disengaged by pressurization of a fluid actuator 31 which then forces the member 27 out of engagement with member 24 to disconnect the drum from the drive shaft.

To transmit drive from engine 14 to drum 12 when it is desired to reel in cable, the engine turns a winch system input member 32 which is secured on an input shaft 33 that is in turn supported by bearings 34. Shaft 33 also carries a transfer gear 36 which engages another transfer gear 37 to transmit drive to an input member 38 of a normally disengaged input clutch 39 of the friction disc type. Clutch 39 has one or more output discs 41 which are spline-connected to an output shaft 42 for axial movement thereon and which are spring-biased towards a position at which the disc or discs are free of engagement with input member 38. Input clutch 39 may be selectively engaged by pressurizing a fluid actuator 43 which then urges output disc 41 towards input member 38 to effect engagement.

Shaft 42, supported by another bearing 44, carries a transfer gear 46 which engages another transfer gear 47 secured to a shaft 48 which is supported by still another bearing 49. Drive is transmitted from shaft 48 to the winch drum drive shaft 21 through a bevel gear 51 on shaft 48 which engages another bevel gear 52 on shaft 21.

To provide for immobilizing the winch drum when necessary, a normally engaged brake mechanism 53 is coupled to shaft 42 through a pair of gears 57 and 58. A stationary shaft 54 carries the gear 57 supported on a bearing 56 which engages the gear 58 carried on the shaft 42. The brake mechanism 53 may be of the friction disc type which includes one or more brake discs 59 spline-coupled to brake shaft 54 for axial movement thereon and spring-biased towards a position at which each disc 59 is urged against a brake disc 61. Brake mechanism 53 may be selectively disengaged by pressurization of a fluid actuator 62 which then urges discs 59 away from discs 61.

With all actuators 31, 43 and 62 unpressurized, the system is in the Brake-On mode of operation at which winch drum 12 is immobilized by brake 53 except for reel-in operation as will be explained below. By pressurizing actuator 43, the Reel-In mode is established at which drive is transmitted to drum 12 to reel in cable. Pressurization of actuator 62 is unnecessary as will be explained below. When a load is pulling on the cable 13, cable may be released by pressurizing only actuator 62 to disengage brake 53 and establish the Brake-Off mode. In this mode of operation, there is a limited degree of resistance to release of the cable due to the drag created by the frictional resistance and inertia of the gearing system coupled to the drum through disconnect clutch 23. That resistance is typically sufficiently high that it is very difficult or impossible to manually withdraw cable from the drum when there is no load pulling on the cable. To facilitate such manual withdrawal of cable, actuator 31 may be pressurized to establish the Free-Spool mode at which the drum is uncoupled from drum drive shaft 21 and the other elements of the drive train.

Referring now to FIG. 3, there is shown a control valve 63 through which the clutch and brake actuators 31, 43 and 62 may be selectively pressurized by movement of the operator's control lever 16 to effect any of the above modes of winch operation, the control valve being shown at the Brake-On position at which all actuators are unpressurized. Control valve 63 has a valve body 64 with a bore 66 in which a valving element formed by a spool 67 is disposed. Spool 67 is shiftable along the axis of bore 66 by pivoting of control lever 16.

Valve body 64 has a fluid inlet chamber 68 and an additional bore 69 in which a pressure-modulating relief valve assembly 71 is disposed. A groove 72 in bore 66 is communicated with inlet chamber 68 and receives pressurized fluid from a pump 73 through a conduit 74. Pump 73, which may be driven by the previously described vehicle engine or other means, draws fluid from a sump 76 through a filter 77.

Modulating relief valve assembly 71 functions to establish a fluid pressure in inlet chamber 68 which is normally at a predetermined level sufficient to fully actuate the previously described clutches and brake through the associated actuators but also functions to drop the pressure in inlet chamber 68 to a lower level when the spool 67 is shifted to the Brake-On position and thereafter to produce a controlled rise of the pressure back up to the maximum level following movement of the spool away from the Brake-On position in either direction.

The modulating relief valve assembly may include a spool 78 having a pair of lands 79 and 79' separated by a groove 81, the spool being disposed for axial movement in a reduced-diameter extension 82 of bore 69. Bore extension 82 is communicated with inlet chamber 68 and, in conjunction with an edge of spool land 79', forms a flow metering passage through which fluid from the inlet chamber may be released to a discharge conduit 83 to provide lubricating oil at relatively low pressure, e.g., about 40 psig and regulate system pressure. A pair of coaxial springs 84 and 86 extend within bore 69 between the end of the spool 78 and a load piston 87 at the opposite of the bore 69 to urge the spool to a position at which land 79' blocks the release of fluid from bore extension 82. The force of springs 84 and 86 on spool 78 is opposed by fluid pressure in another chamber 88 which receives fluid from inlet chamber 68 through a check valve 89. Fluid may be gradually released from chamber 88 back into the inlet chamber 68 through a restricted flow orifice 91.

Thus the position of valve spool 78 is determined by the extent to which fluid pressure in chamber 88 acting on the spool is able to overcome the opposed force of springs 84 and 86 on the spool and thereby permit a controlled release of fluid from inlet chamber 68. The springs are selected to establish a predetermined base pressure within the inlet chamber 68 which is low in relation to the pressure required to fully actuate the previously described clutches and brake. Thus, with the load piston 87 fully to the left as viewed in FIG. 3, the fluid pressure within chamber 88 is able to shift spool 78 sufficiently to discharge fluid from inlet chamber 68 at a rate which keeps the inlet chamber pressure at a low value. If load piston 87 is then shifted rightwardly to increase the spring force on valve spool 78, the pressure within the inlet chamber 68 and in chamber 88 must rise to a higher value in order to force the spool 78 to the position at which fluid can continue to be released. Thus system pressure may be raised in a modulated manner by shifting load piston 87 progressively to the right as viewed in FIG. 3.

To control the load piston 87 so that system pressure is minimal at the Brake-On setting of lever 16 and rises in a modulated manner when the lever is moved away from that position in either direction, a chamber 92 behind the load piston at the end of bore 69 is communicated with the tank 76 through a passage 93 which extends across valve spool bore 66. Valve spool 67 has a land 94 which blocks flow through passage 93 at any position of spool 67 other than the Brake-On position. At the Brake-On position, a groove 96 on land 94 enables fluid to discharge from load piston chamber 92 through passage 93.

Load piston chamber 92 receives fluid from inlet chamber 68 through a flow orifice 97. This flow of pressurized fluid into the load piston chamber 92 does not move the load piston 87 when control spool 67 is in the Brake-On position since the load piston chamber is vented at that time through drain passage 93 and spool groove 96. However, if the control spool 67 is shifted away, in either direction, from the Brake-On position, drain passage 93 is blocked. The flow of pressurized fluid through orifice 97 then raises the pressure in chamber 92 causing the load piston 87 to move to the right as seen in FIG. 3 thereby raising the system pressure within inlet chamber 68 as described above. Accordingly, a shift of the control lever 16 in either direction away from the Brake-On position is followed by a rise of system pressure within inlet chamber 68. The pressure then remains at a high level until control spool 67 is again shifted to the Brake-On position at which the pressure behind the load piston 87 is relieved.

Considering now the action of the valving element spool 67 in distributing pressurized fluid to appropriate ones of the clutches and brake at the various positions of the spool, bore 66 has a groove 98 which is communicated with the brake actuator 62 of FIG. 2 through a brake line 99. Referring again to FIG. 3, bore 66 has an additional groove 101 which receives pressurized fluid from inlet chamber 68 through a check valve 102. Spool 67 has a series of flow-metering grooves 103 located to increasingly release pressurized fluid from groove 101 into groove 98 when the control spool is shifted toward the Brake-Off position to pressurize the brake actuator and thereby release the brake. An adjacent set of metering slots 104 on spool 67 communicate groove 98 with an adjacent drain groove 106 when the spool is at the Brake-On position thereby de-pressurizing the brake actuator and engaging the brake.

To pressurize a line 107 communicated with input clutch actuator 43 at the Reel-In position of lever 16 while venting that actuator to tank at all other positions of the lever, bore 66 has still another groove 108 communicated with line 107 and situated between the previously described fluid supply groove 72 and drain groove 106. Spool 67 has an additional land 109 positioned to block groove 108 from the supply groove 72 while communicating groove 108 with drain groove 106 at the Brake-On position of spool 67 and also at the Brake-Off and Free-Spool positions which are realized by rightward movement of spool 67 from the Brake-On position as viewed in FIG. 3. When the control spool 67 is shifted leftwardly to the Reel-In position, land 109 blocks groove 108 from the drain groove 106 and then communicates groove 108 with inlet groove 72 to pressurize the input clutch line 107.

The disconnect clutch pressurization line 111 is communicated with still another groove 112 of bore 66. Another land 113 of control spool 67 is positioned to block groove 112 from suply groove 72 while communicating groove 112 with an adjacent drain groove 114 at all positions of spool 67 other than the Free-Spool position which is realized by moving the spool to the extreme rightward position as viewed in FIG. 3. Accordingly, the disconnect clutch actuator is pressurized to release the winch drum for unresisted rotation only at the Free-Spool position of the control valve.

If the pump 73 which supplies pressurized fluid to the system should stop operating because of malfunction of the driving engine or for some other reason, the loss of pressure in the several actuator lines 99, 107 and 111 will automatically bring about the Brake-On condition at which the winch drum is immobilized. However, under this condition there may be circumstances at which the operator desires to controllably release cable from the winch to relieve the force of the load on the cable. To enable release of the brake for this purpose, another check valve 116 transmits fluid from pump 73 to an accumulator 117 which is communicated with still another groove 118 of bore 66. Two slots 119 are positioned 180° apart on spool land 94 so as not to communicate with passage 93 in reel-in position, but to transmit pressurized fluid from the accumulator to groove 101 via slots 103 to groove 98 only when the spool 67 is shifted fully to the right, as seen in FIG. 3, to the Free-Spool position. This does not interfere with operation of the system when pump 73 is delivering pressurized fluid since groove 101 is already pressurized at the Free-Spool position by other means as described above. Although the control valve is shifted to the Free-Spool position for the above-described special purpose, it should be observed that a true Free-Spool mode of operation does not result in the absence of system pressure since the disconnect clutch line 111 cannot be pressurized under that circumstance.

Figure 4:
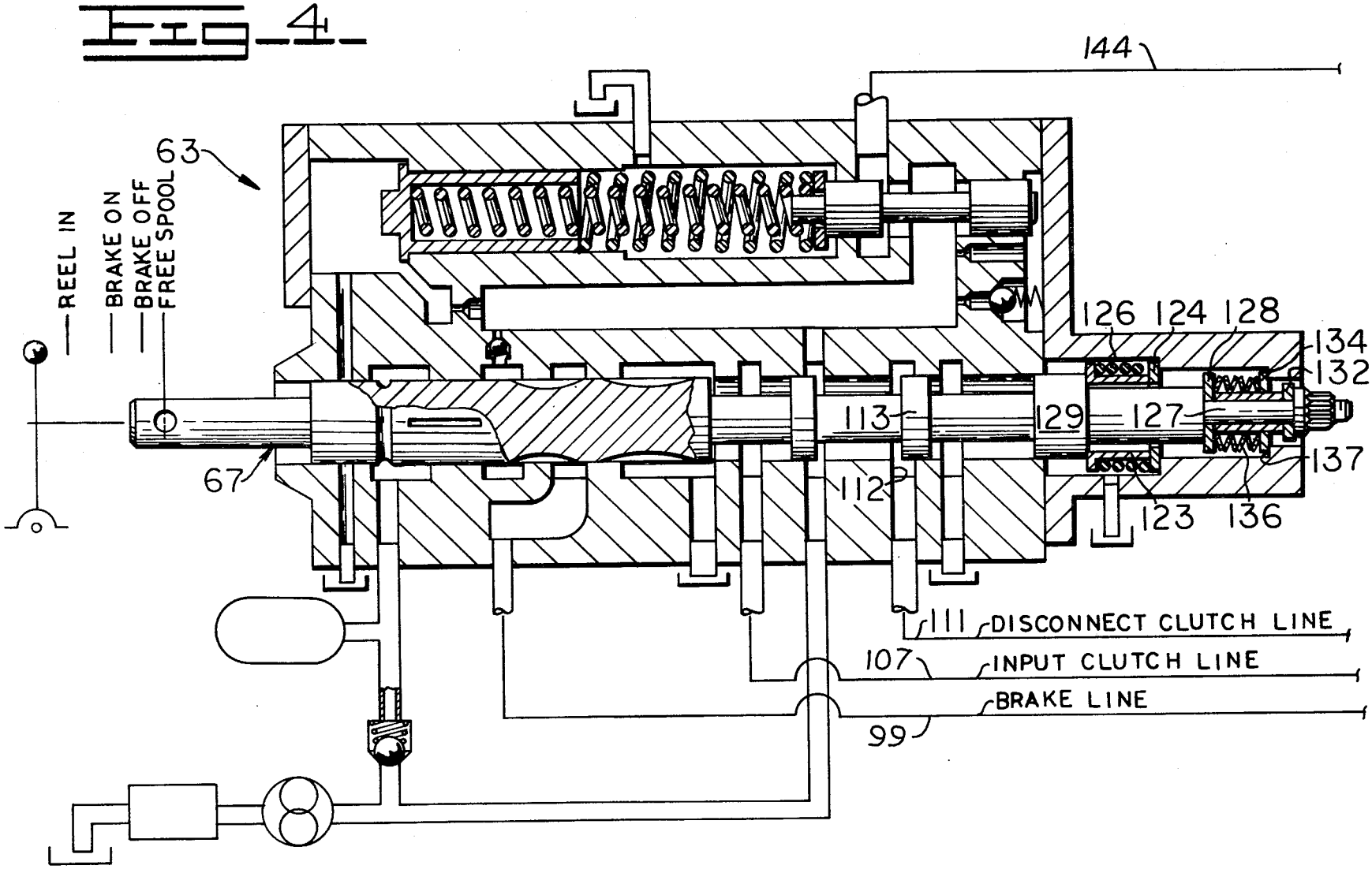
FIG. 4 illustrates in a sectional view the control valve of FIG. 3 after shifting to a Free-Spool position at which there is no significant resistance to turning of the winch drum and at which cable may readily be withdrawn from the winch drum.

From the foregoing it may be seen that the clutch and brake pressurizations and de-pressurizations needed to effect the several decribed modes of which operation may be realized by simply shifting the operator's control lever 16 between the appropriate one of the four positions of the lever. In order to restore the valving element spool 67 and lever 16 to the Brake-On position automatically when the lever is released a centering spring assembly 121 is situated in a chamber 122 adjacent to the end of bore 66. Chamber 122 is of a larger diameter than the adjacent end of bore 66 and contains a sleeve 123 having a flange 123' at the end adjacent bore 66, the end of the spool 67 being extended through the sleeve in coaxial relationship therewith. Chamber 122 also contains an annular element 124 through which the end of spool 67 extends and a centering spring 126 which extends between the flange of sleeve 123 and the annular element 124 in coaxial relationship with the spool end. A sub-chamber 122' forms a lesser-diameter extension of chamber 122 and a bolt 127 extends axially from the end of spool 67 within sub-chamber 122' and has a washer 128 disposed coaxially thereon adjacent the end of the spool. Spring 126 urges a sleeve 123 and annular member 124 in opposite directions. Movement of sleeve 123 is limited by abutment of the flange 123' against one end of chamber 122 while movement of annular member 124 is limited by abutment against the other end of the same chamber. As annular 124 bears against washer 128 while sleeve flange 123' may exert a force against an adjacent land 129 of spool 67 the effect of the centering spring assembly is to continually urge the spool 67 towards the Brake-On position. If the spool 67 is shifted rightwardly as viewed in FIG. 3, land 129 acting through sleeve 123 tends to compress spring 126 while if the spool is shifted in the opposite direction, washer 128 acting through annular member 124 again tends to compress the spring. Spool travel is limited in either direction by abutment of sleeve 123 against annular member 124 as shown in FIG. 4.

Considering now the means which acts to produce an abrupt, kinesthetically detectable increase in the resistance to movement of spool 67 and control lever 16 as the Free-Spool position is approached, with reference again to FIG. 3, a sleeve 131 is disposed coaxially around bolt 127 and extends from washer 128 to another washer 132 which in turn abuts an enlarged head 133 on the end of the bolt. An annular element 134 is disposed coaxially on sleeve 131 adjacent washer 132 and a plurality of annular belleville springs 136 of conical section shape are disposed coaxially on sleeve 131 between washers 128 and 134 to resist movement of one washer towards the other with a resilient force. It will be apparent that other forms of spring may extend between the two washers 128 and 134 if desired.

Chamber extension 122' has an internal step 137 positioned to be contacted by annular element 134 upon movement of the valve spool 67 toward the Free-Spool position just prior to the time that position is reached. Accordingly, further movement of the valve spool 67 and control lever 16 into the Free-Spool position can only be accomplished by compressing the belleville springs 136 as illustrated in FIG. 4. This additional resistance to spool movement enables the operator to sense when the winch drum is about to be freed from any significant resistance against rotation so that he may terminate further control lever movement if he does not in fact desire to establish that condition.

Referring now once again to FIG. 2 there is illustrated therein in accordance with the present invention normally disengaged auxiliary brake means 140 for stopping rotation of the winch drum 12 caused by viscous drag of hydraulic fluid on drive means 142, which drive means include the normally disengaged input clutch 39, the normally engaged brake 53 and the normally engaged disconnect clutch 23 along with the various drive train gearing components previously discussed. Hydraulic lubricating fluid in which these components are usually at least partially immersed can cause a viscous drag on the drive means when the valving element formed by the spool 67 illustrated in FIG. 3 is in the Brake-On position due to limited slippage occuring in a one-way roller clutch 143 which is shown schematically in FIG. 2. A more detailed description of a particular clutch 143 which is useful in an apparatus in accordance with the present invention and in which some limited slippage can occur in a Brake-On mode is found in co-pending application Ser. No. 751,562 entitled "BRAKE ONE WAY WINCH" filed concurrently herewith of Ronald E. Wineburner and Norman R. Allen, commonly assigned herewith. The description of said clutch 143 and its mode of operation as described in said co-pending application are hereby incorporated herein by reference thereto. Briefly, the clutch 143 is desirable in that it allows free rotation of the brake 53 in the Reel-In mode of operation thus eliminating, or at least making much less critical, the necessity or simultaneously activating the clutches 23 and 39 and the brake 53. As a result, however, when the system is shifted from the Reel-In mode to the Brake-On mode, reeling in can continue to occur via the designed slippage in the clutch 143 due to viscous drag exerted by hydraulic fluid on components of drive means 142. When hydraulic fluid is supplied to activate the auxiliary brake means 140 as via a conduit 144 which directs hydraulic fluid to a chamber 146, a ring piston 148 is forced into contact with a ring plate 150 attached to the gear 57. The contact between the ring piston 148 and the ring plate 150 causes a braking force to be applied to the gear 57 thus braking the gear 52, the gear 46, the gear 47, the gear 51, the gear 52 and the winch drum 12 against viscous drag exerted by the hydraulic fluid. It is clear that the auxiliary brake means 140 thus acts against the drive means intermediate the brake 53 and the disconnect clutch 23.

Fluid flow directing means 152 illustrated most clearly in FIGS. 5 and 6 and shown schematically in FIG. 2 is provided intermediate the winch lubricating means which include a discharge conduit 83 and lubricating line means, in the embodiment illustrated a pair of lubricating lines 154 and the auxiliary brake means 140. The fluid flow directing means 152 directs a flow of pressurized fluid from the winch lubricating means to the auxiliary brake means 140 responsive to shifting of the valving element means to the Brake-On position. The fluid flow directing means 152 also blocks said flow of pressurized fluid from the winch lubricating means to the auxiliary brake means 140 responsive to shifting of the spool 67 to each of Brake-Off, Reel-In and Free-Spool positions. Thus, the auxiliary brake means 140 is applied only in the Brake-On position and operates off of lubricating oil pressure from the discharge conduit 83.

Turning now primarily to FIGS. 5 and 6 it will be noted that pressure from the discharge conduit 83 enters a first passage 156 in the fluid flow directing means 152. Thence, the lubricating fluid flows via a second passage 158 in the fluid flow directing means 152 to a bore 160. Within the bore 160 there is a spool 162 and a slug 164. The spool 162 is biased by a spring 166 acting to force the spool 162 and the slug 164 towards a first end 168 of the bore 160. The slug 164 sits between the spool 162 and the first end 168 of the bore 160. Stop means, in the embodiment illustrated a post 170 prevents the slug 164 from travelling to the first end 168 of the bore 160. The spring 166 is generally in a second end 172 of the bore 160. In the mode illustrated in FIG. 6, the control valve 63 is in the Brake-On position. In this position, the spring 166 has foced the spool 162 and the slug 164 upwardly against the post 170. Fluid is introduced to the bore 160 via the second passage 158. The spool 162 includes an undercut 173 thereon which in the Brake-On mode communicates the second passage 158 in the fluid flow directing means 152 with a third passage 174 of the fluid flow directing means 152, which third passage 174 communicates via the conduit 144 with the auxiliary brake means 140 and operates in a manner previously explained. The fluid flow directing means 152 further includes a fourth passage 176 through which fluid from the first passage 156 is led off to lubricate the winch 12 via the pair of lubricating lines 154. It will be noted that communication is thus always retained between the first passage 156 and the fourth passage 176 and thus between the discharge conduit 83 and the pair of lubricating lines 154.

When the control valve 63 is shifted to the Reel-In position hydraulic pressure is directed via the line 107 to the input clutch 39 and via the line 99 to the brake 53. Thus, the input clutch 39 is thereby engaged and the brake 53 is thereby disengaged. Because of the presence of the one-way clutch 143 it is not necessary to precisely sequence this operation and indeed it is not absolutely necessary to pressurize the brake 53. The pressure being applied to the input clutch 39 is likewise appled via a fifth passage 178 in the fluid flow directing means 152 to an annulus 180 about the post 170. The fluid pressure in the annulus 180 then acts against the slug 164 forcing it against the spool 162 thus forcing the biasing of the spring 166 to be overcome whereby the spool 162 is propelled towards the second end 172 of the bore 160 sufficiently to cut off communication of the second passage 158 with the third passage 174 whereby lubricating fluid pressure is not applied to the auxiliary brake means 140. In particular operation, the land 182 upon the spool 162 cuts off the second passage 158 at the bore 160. Meanwhile, the third passage 174 communicates via the undercut 173 in the spool 162 and the bore 160 with a drain passage 184 in the fluid flow directing means 152 whereby pressure in the chamber 146 of the auxiliary brake means 140 is connected to drain via the conduit 144, the third passage 174, the undercut 173 and the drain passage 184. It should be noted that in the Reel-In position fluid pressure is not supplied via the brake line 99 but is instead drained in control valve 63.

When the control valve 63 is placed in the Brake-Off position or in the Free-Spool position, pressure is applied to the brake 53 via the brake line 99 and thence to about the second undercut 188 in the spool 162. This leads to the spool 162 being forced against the biasing of the spring 166 sufficiently to cut off incoming flow from the second passage 158 and to connect the chamber 146 of the auxiliary brake means 140 to drain via the drain passage 184. The pressure about the second undercut 188 in the spool 162 is also applied to the slug 164 to hold it upwards against post 170 and prevent communication of pressurized fluid from the undercut 188 to the annulus 180. Whenever the control valve 63 is returned to the Brake-On position from any of the Reel-In, Brake-Off, or Free-Spool positions, the auxiliary brake means 140 is reapplied. Whenever there is no pressure in the annulus 180 or about the second undercut 188 in the spool 162, the spring 166 moves the spool 162 and the slug 164 upward against the post 170. Lubrication oil pressure is then again routed around the spool 162 as previously via the first passage 156, the second passage 158 and the third passage 174 to the conduit 144 and thence to the auxiliary brake means 140.

While the invention has been described in connection with specific embodiments thereof, it will be understood that it is capable of further modification, and this application is intended to cover any variations, uses or adaptations of the invention following, in general, the principles of the invention and including such departures from the preent disclosure as come within known or customary practice in the art to which the invention pertains and as may be applied to the essential features hereinbefore set forth, and as fall within the scope of the invention and the limits of the appended claims.

What is claimed is:

1. In a winch and fluid control system which comprises (1) a rotatable drum for receiving and releasing a cable, (2) drivemeans drive means supporting said drum and for selectively transmitting rotary motion thereto, said drive means including a brake therefor, (3) a source of pressurized fluid, (4) control valve means having inlet means communicating with said source of pressurized fluid and having outlet means, said control valve means having valving element means shiftable between at least three positions including a Brake-On position, a Reel-In position at which said brake is off and said drive means is reeling in said cable, and a Brake-Off position and (5) winch lubricating means communicating said source of pressurized fluid with said winch, an improvement comprising:

a one-way clutch associated in series with said brake allowing said drum to rotate in a reel-in direction when said brake is engaged;

normally biased to be disengaged auxiliary drag brake means in parallel with said brake which engages on application of fluid pressure thereto for stopping rotation of said drum caused by viscous drag of hydraulic lubricating fluid on said drive means when said valving element means is in said Brake-On position; and fluid flow directing means intermediate said winch lubricating means and said auxiliary brake means which directs a flow of pressurized fluid from said winch lubricating means to engage said auxiliary brake means responsible to shifting of said valving element means to said Brake-On position and directs said flow of pressurized fluid from said winch lubricating means to said auxiliary brake means to disengage said auxiliary drag brake means responsive to shifting of said valving element means to any of said Brake-Off and Reel-In positions whereby said auxiliary brake means operates to overcome slippage in said one-way clutch in a reel-out direction when said brake is engaged.

2. An improvement as in claim 1, wherein said drive means includes a disconnect clutch for said drum and said auxiliary brake means acts against said drive means intermediate said brake and said disconnect clutch.

3. An improvement as in claim 2, including drain means communicating said auxiliary brake means with drain when said valving element means is in other than said Brake-On position.

4. In a winch and fluid control system which comprises (1) a rotatable drum for receiving and releasing a cable, (2) drive means for supporting said drum and for selectively transmitting rotary drive thereto, said drive means including a brake therefor, (3) a source of pressurized fluid, (4) control valve means having inlet means communicating with said source of pressurized fluid and having outlet means, said control valve means having valving element means shiftable between at least three positions including a Brake-On position, a Reel-In position and a Brake-Off position and (5) winch lubricating means communicating said source of pressurized fluid with said winch, an improvement comprising:

a one-way clutch associated with said brake allowing said drum to rotate in a reel-in direction when said brake is engaged;

normally biased to be disengaged auxiliary drag brake means which engage on application of fluid pressure thereto for stopping rotation of said drum caused by viscous drag of hydraulic lubricating fluid on said drive means when said valving element means is in said Brake-On position;

a disconnect clutch for said drum included within said drive means, said auxiliary brake means acting against said drive means intermediate said brake and said disconnect clutch;

drain means communicating said auxiliary brake means with drain means when said valving element means is in other than said Brake-On position; and fluid flow directing means intermediate said winch lubricating means and said uxiliary brake means which directs a flow of pressurized fluid from said winch lubricating means to engage said auxiliary brake means responsive to shifting of said valving element means to said Brake-On position and directs said flow of pressurized fluid from said winch lubricating means to said auxiliary brake means to disengage said auxiliary brake means responsive to shifting of said valving element means to any of said Brake-Off and Reel-In positions; wherein said drive means includes an input clutch which is normally biased to be disengaged and which engages on application of fluid pressure thereto, said brake is normally biased to be engaged and disengages on application of fluid pressure thereto, said fluid flow directing means comprises a bore within a body, a spool moveable reciprocally within said bore, first passage means through said body communicating said winch lubricating means with said bore at a first location adjacent said spool, second passage means through said body communicating said auxiliary brake means with said bore at a second location adjacent to said spool spaced from said first location, means biasing said spool to a region of said bore which allows said first location to communicate with the said second location, third passage means communicating a fluid outlet of said brake with said bore at a third location spaced from said first and second locations, said third location applying fluid pressure from said brake fluid outlet to overcome said biasing means and move said spool to block communication between said first and second locations and fourth passage means communicating an outlet of said input clutch with said bore at a fourth location spaced from said first, second and third locations, said fourth location applying fluid pressure from said input clutch outlet to overcome said biasing means and move said spool to block communication between said first and second locations.

5. An improvement as in claim 4, wherein said bore includes a slug slidably reciprocally fitting therewithin disposed against an opposite side of said spool from said biasing means, said third position is on an opposite side of said slug from said spool and said fourth position is generally intermediate said spool and said slug.

6. An improvement as in claim 5, wherein said winch lubricating means includes a winch lubricating outlet on said control valve means and said first passage means communicates with said winch lubricating outlet.

7. In a winch and fluid control system which comprises (1) a rotatable drum for receiving and releasing a cable, (2) drive means for supporting said drum and for selectively transmitting rotary drive thereto, said drive means including a brake therefor, (3) a source of pressurized fluid, and (4) control valve means having inlet means communicating with said source of pressurized fluid and having outlet means, said control valve means having valving element means shiftable between at least three positions, including a Brake-On position, a Reel-In position at which said brake is off and said drive means is reeling in said cable, and a Brake-Off position, an improvement comprising:

a one-way clutch associated in series with said brake allowing said drum to rotate in a reel-in direction when said brake is engaged;

normally biased to be disengaged auxiliary drag brake means in parallel with said brake which engages on application of fluid pressure thereto for stopping rotation of said drum caused by viscous drag of hydraulic lubricating fluid on said drive means when said valving element means is in said Brake-On position; and fluid flow directing means which directs a flow of pressurized fluid to engage said auxiliary brake means responsive to shifting of said valving element means to said Brake-On position and directs said flow of pressurized fluid to said auxiliary brake means to disengage said auxiliary brake means responsive to shifting of said valving element means to any of said Brake-Off and Reel-In positions whereby said auxiliary brake means prevents reel-out rotation of said drum due to slippage in said one-way clutch.

* * * * *

UNITED STATES PATENT AND TRADEMARK OFFICE

CERTIFICATE OF CORRECTION

PATENT NO. : 4,090,693

DATED : May 23, 1978

INVENTOR(S) : Richard F. Hoehn, Norman R. Allen and Ronald E. Wineburner

It is certified that error appears in the above-identified patent and that said Letters Patent are hereby corrected as shown below:

In the claims:

Column 11, line 36: delete "drivemeans"

Column 12, line 4: delete "reel-out" and insert ---reel-in---.

Column 14, lines 27-28: delete "reel-out" and insert ---reel-in---.

Signed and Sealed this

*Twenty-second* Day of *July 1980*

[SEAL]

*Attest:*

SIDNEY A. DIAMOND

*Attesting Officer*

*Commissioner of Patents and Trademarks*